US006086716A

United States Patent [19]

Watson et al.

[11] Patent Number: 6,086,716

[45] **Date of Patent: *Jul. 11, 2000**

[54] WET END CONTROL FOR PAPERMAKING MACHINE

[75] Inventors: John David Watson, Etobicoke; Claud Hagart-Alexander, Vancouver, both of Canada; John D. Goss, San Jose, Calif.; John G. Preston, Los Altos, Calif.; Hung-Tzaw Hu, Saratoga, Calif.; Laslo Dudas, East Brunswick, N.J.

[73] Assignee: Honeywell-Measurex Corporation, Cupertino, Calif.

[ * ] Notice: This patent is subject to a terminal disclaimer.

[21] Appl. No.: 09/075,762

[22] Filed: May 11, 1998

[51] Int. Cl.[7] ..... G01R 27/26; D21F 1/66

[52] U.S. Cl. ..... 162/198; 162/263; 162/262; 162/DIG. 6; 700/428; 324/664

[58] Field of Search ..... 162/198, 263, 162/262, 252, 258, 259, DIG. 10, DIG. 11, DIG. 6; 324/664, 665; 364/471.02; 700/127, 128, 129

[56] References Cited

U.S. PATENT DOCUMENTS

| | | |
|---|---|---|
| 3,260,642 | 7/1966 | Canter . |
| 3,593,128 | 7/1971 | Perry . |
| 3,630,836 | 12/1971 | Bietry et al. . |
| 3,636,327 | 1/1972 | Troutman . |
| 3,646,434 | 2/1972 | Norwich . |
| 3,654,075 | 4/1972 | Keyes et al. . |
| 3,713,966 | 1/1973 | Lippke . |
| 3,723,712 | 3/1973 | Komline, Sr. et al. . |
| 3,723,865 | 3/1973 | Batey et al. . |
| 3,795,984 | 3/1974 | Meyer . |
| 3,811,087 | 5/1974 | Schmelzer . |
| 3,864,626 | 2/1975 | MacLean et al. . |
| 3,909,380 | 9/1975 | Day et al. . |
| 3,986,110 | 10/1976 | Overall et al. . |
| 4,135,151 | 1/1979 | Rogers et al. . |
| 4,259,632 | 3/1981 | Ahtiainen . |
| 4,314,878 | 2/1982 | Lee . |
| 4,329,201 | 5/1982 | Bolton . |
| 4,369,080 | 1/1983 | Johnson . |
| 4,398,996 | 8/1983 | Bolton et al. . |
| 4,468,611 | 8/1984 | Tward . |
| 4,474,643 | 10/1984 | Lindblad . |
| 4,514,812 | 4/1985 | Miller et al. . |
| 4,535,285 | 8/1985 | Evans et al. . |

(List continued on next page.)

FOREIGN PATENT DOCUMENTS

| | | |
|---|---|---|
| 0 276 106 | 7/1988 | European Pat. Off. . |

OTHER PUBLICATIONS

Smook, G.A., Handbook for Pulp & Paper Technologists, 2d. ed., (Angus Wilde Publications), 1992, pp. 228–229.

*Primary Examiner*—Stanley S. Silverman
*Assistant Examiner*—José A. Fortuna
*Attorney, Agent, or Firm*—Burns, Doane, Swecker & Mathis, L.L.P.

[57] ABSTRACT

System and method for producing paper are provided. The system controls formation of wet stock comprising fibers on a moving water permeable wire of a de-watering machine that has means for supplying the amount of pulp from at least one source, means for adding an amount of non-fibrous additives to the wet stock, a refiner that is subject to a variable load and a headbox having at least one slice, wherein each slice has an aperture through which wet stock is discharged onto the wire. The system includes: (a) at least two water weight sensors that are positioned adjacent to the wire wherein the at least two sensors are positioned at different locations in the direction of movement of the wire and upstream from a dry line which develops during operation of the machine and the sensors generate signals indicative of a water weight profile made up of a multiplicity of water weight measurements; and (b) means for adjusting at least one of the motor load controller, the amount of non-fibrous additives added to the wet stock or amount of pulp supplied from the at least one source to cause the water weight profile to match a preselected or optimal water weight profile.

34 Claims, 4 Drawing Sheets

U.S. PATENT DOCUMENTS 4,580,233 4/1986 Parker et al. .
4,588,943 5/1986 Hirth .
4,613,406 9/1986 Gess .
4,648,715 3/1987 Ford, Jr. et al. .
4,680,089 7/1987 Aral et al. .
4,692,616 9/1987 Hegland et al. .
4,707,779 11/1987 Hu .
4,748,400 5/1988 Typpo .
4,786,529 11/1988 Boissevain .
4,791,353 12/1988 Typpo .
4,817,021 3/1989 Sowerby et al. .
4,827,121 5/1989 Vidrine, Jr. et al. .
4,840,706 6/1989 Campbell .
4,845,421 7/1989 Howarth et al. .
4,903,528 2/1990 Balakrishnan et al. .
4,909,070 3/1990 Smith .
4,921,574 5/1990 Hu .
4,924,172 5/1990 Holmgren .
4,947,684 8/1990 Balakrishnan .
4,957,770 9/1990 Howarth .
4,980,846 12/1990 Chapman .
4,986,410 1/1991 Shields .
4,990,261 2/1991 Ho .
4,994,145 2/1991 Seymour .
5,013,403 5/1991 Chase .
5,020,469 6/1991 Boissevain et al. .
5,021,740 6/1991 Sarr et al. .
5,022,966 6/1991 Hu .
5,045,798 9/1991 Hendrick .
5,052,223 10/1991 Regnault et al. .
5,067,345 11/1991 Mougne .
5,093,795 3/1992 Lewis .
5,122,754 6/1992 Gotaas .
5,124,552 6/1992 Anderson .
5,132,631 7/1992 Klopfenstein et al. .
5,134,380 7/1992 Jonas .
5,170,128 12/1992 Masurat et al. .
5,170,670 12/1992 Fasching et al. .
5,177,445 1/1993 Cross .
5,198,777 3/1993 Masuda et al. .
5,206,599 4/1993 Mayer .
5,208,544 5/1993 McBrearty et al. .
5,225,785 7/1993 Mayer et al. .
5,241,280 8/1993 Aidun et al. .
5,244,550 9/1993 Inoue .
5,247,261 9/1993 Gershenfeld .
5,262,955 11/1993 Lewis .
5,270,664 12/1993 McMurtry et al. .
5,280,250 1/1994 Jayaweera et al. .
5,340,442 8/1994 Gess et al. .
5,400,247 3/1995 He .
5,439,910 8/1995 Hall et al. .
5,450,015 9/1995 Mastico et al. .
5,492,601 2/1996 Ostermayer et al. .
5,539,634 7/1996 He .
5,561,599 10/1996 Lu .
5,563,809 10/1996 Williams et al. .
5,636,126 6/1997 Heaven et al. .
5,658,432 8/1997 Heaven et al. .
5,891,306 4/1999 Chase et al. ..... 162/198

WET END CONTROL FOR PAPERMAKING MACHINE

FIELD OF THE INVENTION

The present invention generally relates to controlling continuous sheetmaking, and more specifically to wet end chemistry monitor and control in a papermaking machine.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, and caliper (i.e., thickness) of the sheets at various stages in the manufacturing process. These process variables are typically controlled by, for example, adjusting the feedstock supply rate at the beginning of the process, regulating the amount of steam applied to the paper near the middle of the process, or varying the nip pressure between calendaring rollers at the end of the process. Papermaking devices well known in the art are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheetmaking systems are further described, for example, in U.S. Pat. Nos. 5,539,634, 5,022,966 4,982,334, 4,786,817, and 4,767,935.

In the manufacture of paper on continuous papermaking machines, a web of paper is formed from an aqueous suspension of fibers (stock) on a traveling mesh wire or fabric and water drains by gravity and vacuum suction through the fabric. The web is then transferred to the pressing section where more water is removed by dry felt and pressure. The web next enters the dryer section where steam heated dryers and hot air completes the drying process. The papermaking machine is essentially a de-watering, i.e., water removal, system. In the sheetmaking art, the term machine direction (MD) refers to the direction that the sheet material travels during the manufacturing process, while the term cross direction (CD) refers to the direction across the width of the sheet which is perpendicular to the machine direction.

A wide range of chemicals is utilized in the papermaking stock furnish to impart or enhance specific sheet properties or to serve other necessary purposes. Such additives as alum, sizing agents, mineral fillers, starches and dyes are commonly used. Chemicals for control purposes such as drainage aids, defoamers, retention aids, pitch dispersants, slimicides, and corrosion inhibitors are added as required. Fabrication of quality paper required addition of the proper amount of these chemicals.

Wet end chemistry deals with all the interactions between furnish materials and the chemical/physical processes occurring at the wet end of the papermaking machine. The major interactions at the molecular and colloidal level are surface charge, flocculation, coagulation, hydrolysis, time-dependent chemical reactions and microbiological activity. These interactions are fundamental to the papermaking process. For example, to achieve effective retention, drainage, sheet formation, and sheet properties, it is necessary that the filler particles, fiber fines, size and starch be flocculated and/or adsorbed onto the large fibers with minimal flocculation between the large fibers themselves.

There are three major groups involved in wet-end chemistry: solids, colloids and solubles. Most attention is focused on the solids and their retention. In order to maximize retention, it is important to cause the fines and fillers to approach each other and form bonds or aggregates which are stable to the shear forces encountered in the paper machine headbox and approach system. In modern papermaking, this is usually accomplished by using synthetic polymers.

Control of wet-end chemistry is vital to ensure that a uniform paper product is manufactured. If the system is allowed to get out of balance (e.g., by over-use of cationic polymers), the fibers themselves will become flocculated and sheet formation will suffer. Also, functional additives (e.g., sizes, wet-strength agents) are often added at the wet end; if the chemistry is not under control, the functionality may not be adequately imparted and the product will be off-quality.

The wet end of a papermaking machine is critical in determining the longterm stability of the machine and ultimately the quality of the resulting product. Fluctuations in the volumetric flow from the headbox and/or in the composition (e.g., solids, fines and chemicals) of the pulp slurry or paper stock leaving the headbox will affect the percent solids of the wet fiber mat delivered to the dryer sections. These changes will be detected by the reel scanner but, because of the transport time delay and scanner response time, the dry end moisture control system is inadequate to compensate for these load disturbances.

During normal steady state operation of a papermaking machine, an equilibrium condition develops in the material balance of the short and long stock circulation loops. For the short circulation loop this means that the fines and filler retention of the paper web are in equilibrium with the concentration of these materials in the white water circulation; and for the long circulation this means that the fiber save-all operation, broke filler concentration, retention chemical concentration and furnish composition are stable.

Conventional methods for controlling the basis weight of the paper produced include regulating the paper stock flow rate from the stuff box through a basis weight or thick stock valve into the headbox. The valve is actuated in response to scanning sensor measurements of the paper just before the reel. The ability of this feed-back control technique to smooth out disturbances however is limited due to the long time lags through the machine from the thick stock valve to the reel.

SUMMARY OF THE INVENTION

The present invention is based in part on the development of an underwire water weight sensor (referred to herein as the "$UW^3$" sensor) which is sensitive to three properties of materials: the conductivity or resistance, the dielectric constant, and the proximity of the material to the $UW^3$ sensor. Depending on the material, one or more of these properties will dominate. The $UW^3$ sensors are positioned in a papermaking machine in the MD direction, and are used to measure the conductivity of an aqueous mixture (referred to as wet stock) in a papermaking system. In this case, the conductivity of the wet stock is high and dominates the measurement of the $UW^3$ sensor. The proximity is held constant by contacting the support web in the papermaking system under the wet stock. The conductivity of the wet stock is directly proportional to the total water weight within the wet stock; consequently, the sensors provide information which can be used to monitor and control the quality of the paper sheet produced by the papermaking system.

With the present invention, an array of $UW^3$ sensors is employed to measure the water weight in the MD on the web of a fourdriner paper machine and generate water weight or drainage profiles. These sensors have a very fast response time (1 msec) and are capable of providing an accurate value of the water weight, which relates to the basis weight of the paper. Indeed, the water weight measurements can be computed from the under the wire weight sensor 600 times a second. By monitoring the MD trend of each of the MD sensors in the array, it is possible to correlate the variation of the water weight down the table between each of these sensors.

The method for tuning the operation of a fourdriner machine to produce a specific paper grade comprises a three-step procedure. The first step comprises tuning process parameters of the fourdriner machine to obtain an optimized configuration which produces acceptable quality paper as determined by direct measurement. The drainage profile corresponding to this optimized configuration is then measured with water weight sensors distributed along the machine direction, and recorded.

This optimal drainage profile may then be fitted to various parameterized functions (such as an exponential) using standard curve fitting techniques. This curve fitting procedure has the effect of smoothing out the effects of noise on the profile, and interpolating between measured points.

During subsequent production runs of the fourdriner machine, the objective is to reproduce the previously determined optimal drainage profile. If the measured moisture content at a given position is either above or below the optimal value for that position, the machine parameters, such as the mechanical action of the refiner or wet-end additives are adjusted as necessary to bring that measurement closer toward the optimal value.

In one aspect, the invention is directed to a method of controlling the formation of a sheet of wet stock comprising fibers wherein the wet stock is formed on a water permeable moving wire of a de-watering machine that has means for supplying an amount of pulp from at least one source, means for adding an amount of non-fibrous additives to the wet stocks, a refiner that subjects the fibers to mechanical action, said refiner being subject to a variable load, and a headbox having at least one slice, wherein each slice has an aperture through which wet stock is introduced onto the wire, said method including the steps of:

(a) placing at least two water weight sensors underneath and adjacent to the wire and which are positioned at different locations in the direction of movement of the wire and upstream from a dry line which develops during operation of the machine;

(b) operating the machine and measuring the water weights of the sheet of wet stock with the water weight sensors;

(c) generating signals that are indicative of the water weight measurements and developing a water weight profile based on the signals; and (d) adjusting at least one of said variable load of the refiner, the amount of non-fibrous additives to the wet stock, or the amount of pulp supplied from the at least one source, so that the water weight profile matches a preselected water weight profile.

The invention will, among other things, increase productivity as the papermaker can now quickly determine the proper refiner variable and/or amount of non-fibrous additives for a particular grade of paper. The paper produced will have optimum fiber orientation and composition that is reflected in the sheet formation and strength.

DETAILED DESCRIPTION OF PREFERRED EMBODIMENTS

The present invention employs a system that includes one or more sensors that measure the basis weight of paper stock on the web or wire of a papermaking machine, e.g., fourdrinier. These sensors preferably are sensors which have a very fast response time (1 m sec) so that an essentially instantaneous profile of the basis weight can be obtained. Although the invention will be described as part of a fourdrinier papermaking machine, it is understood that the invention is applicable to other papermaking machines including, for example, twin wire and multiple headbox machines and to paper board formers such as cylinder machines or Kobayshi Formers. Some conventional elements of a papermaking machine are omitted in the following disclosure in order not to obscure the description of the elements of the present invention.

Figure 1:
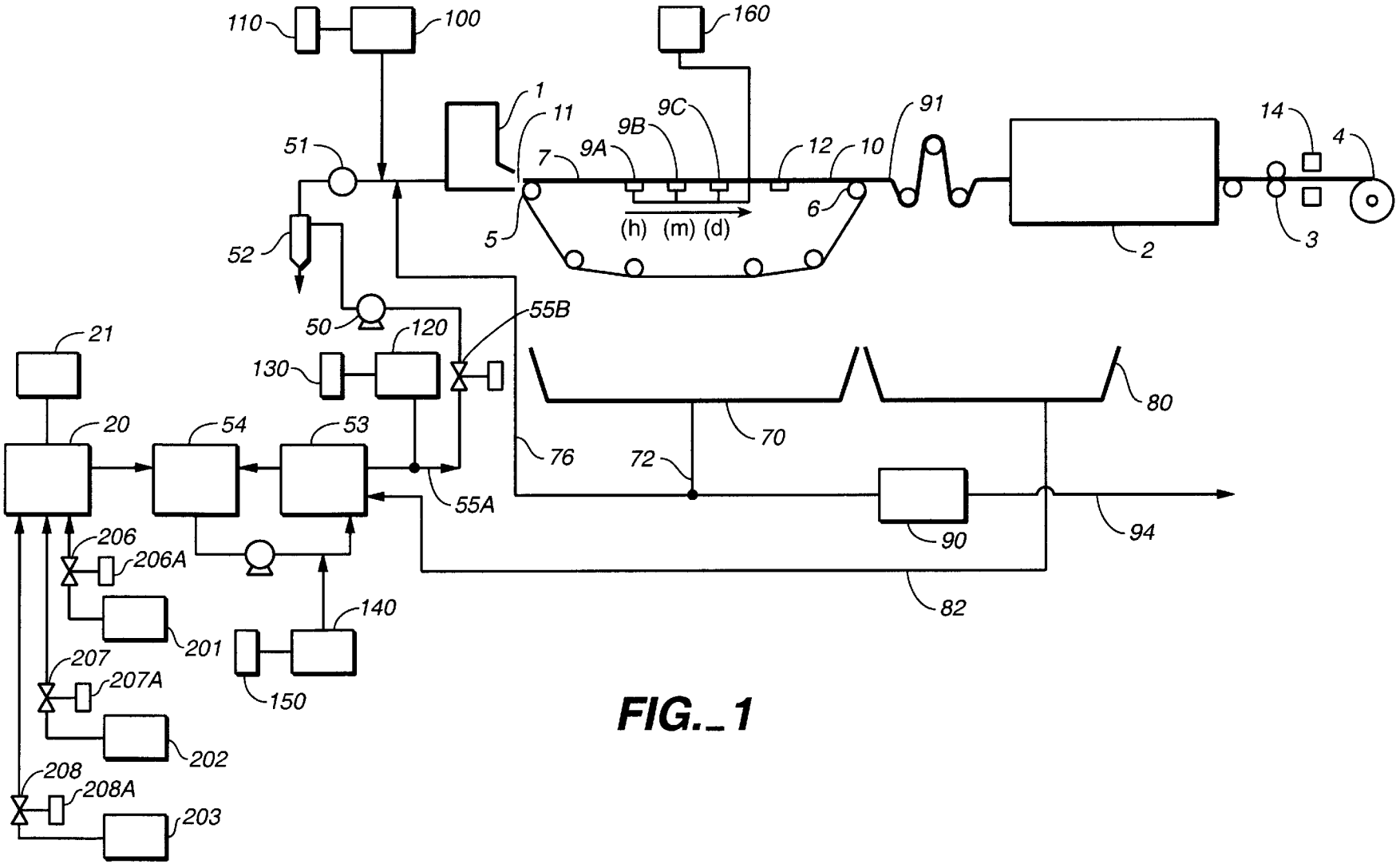
FIG. 1 shows a sheetmaking system implementing the technique of the present invention.

FIG. 1 shows a system for producing continuous sheet material that comprises processing stages including headbox 1, web or wire 7, dryer 2, calendaring stack 3, and reel 4. Actuators (not shown) in headbox 1 discharge wet stock (e.g., pulp slurry) through a plurality of slices 11 onto supporting wire 7 which rotates between rollers 5 and 6. Foils and vacuum boxes (not shown) remove water, commonly known as "white water", from the wet stock on the wire into wire pit 70 for recycle. A portion of the wet stock from the pit is recycled directly to the headbox through lines 72 and 76 whereas another portion of the wet stock is diverted to saveall 90 where it is separated into water which is stored or reused through line 94. The wet stock or white water which is recycled primarily contains fibers, fillers (e.g., clay), and water. This recycle loop is commonly referred to as the short circulation or white water loop. Fiber which is recovered by the saveall is typically recycled as an aqueous mixture through line 94 to the back end of the pan pump. The system also includes a mechanism for recovering broke which is defined as partly or completely manufactured paper or paperboard that is discarded from any point in the manufacturing or finishing process. For example, during a sheet break or start up material exiting the web is recycled. Broke is recovered in reservoir 80 and diverted through line 82 to head tank 53. This loop is commonly referred to as the long circulation loop.

A scanning sensor 14 continuously traverses the finished sheet (e.g., paper) and measures properties of the finished sheet. Multiple stationary sensors could also be used. Scanning sensors are known in the art and are described, for example, in U.S. Pat. Nos. 5,094,535, 4,879,471, 5,315,124, and 5,432,353, which are incorporated herein. The finished sheet is then collected on reel 4. As used herein, the "wet end" portion of this system comprises the headbox, the web, and those sections just before the dryer, and the "dry end" comprises the sections that are downstream from the dryer.

The system further includes means for measuring the basis weight of the sheet of wet stock on the wire. A preferred device is the underwire water weight or $UW^3$ sensor which is employed singly or in combination and which is further described herein. In one embodiment an array of $UW^3$ sensors is positioned under the wire in the CD or MD position. For instance, the basis weight at the wet end can be measured with a CD array 12 of the $UW^3$ sensors that is positioned underneath wire 7. By this is meant that each sensor is positioned below a portion of the wire which supports the wet stock. As further described herein, each of the sensors is configured to measure the water weight of the sheet material as it passes over the array. The array provides a continuous measurement of the entire sheet material along the CD direction at the point where it passes the array. A profile made up of a multiplicity of water weight measurements at different locations in the CD is developed. In one embodiment, an average of these measurements is obtained and converted to the wet end basis weight.

Alternatively, an MD array comprised of three $UW^3$ sensors 9A, 9B, and 9C is positioned underneath wire 7. A water weight profile made up of a multiplicity of water weight measurements at different locations in the MD is developed. The array should have a minimum of 2 sensors. Typically 3 to 6 sensors are employed in tandem and positioned approximately 1 meter from the edge of the wire. Typically, the sensors are positioned about 30 to 60 cm apart from each other. Both the CD and MD array sensors are preferably positioned upstream from a dry line that forms at position 10 on the wire.

The term "water weight" refers to the mass or weight of water per unit area of the wet paper stock which is on the wire. Typically, the $UW^3$ sensors when positioned under the wire are calibrated to provide engineering units of grams per square meter (gsm). As an approximation, a reading of 10,000 gsm corresponds to paper stock having a thickness of 1 cm on the fabric. The term "basis weight" or "BW" refers to the total weight of the material per unit area. The term "dry weight" or "dry stock weight" refers to the weight of a material (excluding any weight due to water) per unit area.

Typically, the papermaking furnish or raw material is metered, diluted, mixed with any necessary additives, and finally screened and cleaned as it is introduced into headbox 1 from fan pump 50. Specifically, although stock from machine chest 54 should be reasonable free from impurities, paper machine approach systems usually utilize pressure screens 51 and centrifugal cleaners 52 to prevent contamination.

Fan pump 50 serves to mix the stock with the white water and deliver the blend to the headbox 1. To ensure a uniform dispersion to the headbox, the stock is fed from a constant head tank 53, commonly called the "stuff box," through line 55A that is regulated by control valve 55B (also called the basis weight valve).

Stock is supplied to machine chest 54 from refiner 20 which includes adjustable mechanical elements, e.g., motorized disk elements or plates to grind the paper fiber surfaces. Generally, the refiner is part of the stock preparation system which prepares, conditions, and/or treats the pulp or stock in such a manner that a satisfactory sheet of paper can be produced. The load to the refiner is regulated by controller 21. Adjusting the load will increase or decrease the degree of mechanical action on the pulp by the mechanical elements in the refiner. The refiner is connected to sources of thick stock and water. For high quality paper typically more than one source of pulp is used. As illustrated in FIG. 1, refiner 20 is connected to three sources 201, 202, and 203 through valves 206, 207, and 208, respectively. The valves in turn are regulated by controllers 206A, 207A and 208A, respectively. The sources of pulp may represent different types of wood (e.g., softwood or hardwood) and/or different pulping mechanisms (e.g., mechanical, chemical or hybrid). While the sources are connected to a single refiner, it is understood that each source may be connected to a separate refiner which is connected to machine chest 54. As is apparent, the flow rate of each sources of pulp can be adjusted. Vigorously grinding the paper stock in the refiner reduces the rate at which water will drain through the wire mesh. Thus, it is common to refer to a rapidly draining stock as being "free", or having high freeness, whereas more highly grinded stock is referred to as being slow, or having low freeness.

The system further includes means for adding non-fibrous additives to the papermaking stock. Chemical additives are added at different steps in the process. Wet-end chemical and mineral additives include, for example, acids and bases, alum, sizing agents, dry-strength adhesives, wet-strength resins, fillers, coloring materials, retention aids, fiber flocculants, defoamers, drainage aids, optical brighteners, pitch control chemicals, slimicides, and specialty chemicals. Some of these chemicals, e.g., alum, can be employed to alter the zeta potential of fiber particles in the stock. The specific types of additives employed will depend on, among other parameters, the grade of paper being made. Source 140 contains a coagulating agent, e.g., alum, which is added to the stock in head tank 53. The alum serves to improve retention of fines and fillers to the fibers. The amount of alum that is added is regulated by controller 150. Source 120 contains flocculants that improve sheet formation by facilitating the binding of fibrous material and fillers. The amount of flocculants added to the line exiting head tank 53 is regulated by controller 130. Finally, source 100 contains specialty chemicals, e.g., corrosion inhibitors, and slimicides. The amount of these components is regulated by controller 110. The above is meant only as an illustration of the different strategies that can be implemented. As is apparent, other chemicals can be added, alternatively, the chemicals can be added at different stages in the process.

The water drainage profile on a fourdrinier wire is a complicated function principally dependent on the arrangement and performance of drainage elements, characteristics of the wire, tension on the wire, stock characteristics (for example freeness, pH and additives), stock thickness, stock temperature, stock consistency wire speed and refiner load or power. By controlling one or more operating parameters of the system the quality of the paper fabricated can be regulated. Although one may adjust the concentration of additives to regulate the final product, and/or regulate the flow of pulp into the refiner when more than one source is employed, generally for a particular grade of paper, it is preferred to maintain the concentration of the additives and pulp flow rates once the optimum levels are set. In a preferred embodiment, the system is employed to control one or more of the other process parameters while keeping the flow of additives and pulp within certain set points. One such parameter is the refiner power. This can be accomplished by using a refiner that has a refiner plate position control system. By subjecting fibers to different levels of mechanical action, the paper stock flowing onto the wire will exhibit different properties, e.g., drainage characteristics.

Water weight sensors placed at strategic locations along the papermaking fabric can be used to profile the de-watering process (hereinafter referred to as "drainage profile"). By varying the above stated process parameters and measuring changes in the drainage profile, one can then construct a model which simulates the wet end paper process dynamics. Conversely one can use the model to determine how the process parameters should be varied to maintain or produce a specified change in the drainage profile.

Three water weight sensors 9A, 9B, and 9C are illustrated to measure the water weight of the paper stock on the wire. The position along the fabric at which the three sensors are located are designated "h", "m", and "d", respectively. More than three water weight sensors can be employed. It is not necessary that the sensors be aligned in tandem, the only requirement is that they are positioned at different machine directional positions and underneath the wire. Preferably the sensors are immediately adjacent to the wire. Typically, readings from the water weight sensor at location "h" which is closest to the headbox will be more influenced by changes in stock freeness than in changes in the dry stock since changes in the latter is insignificant when compared to the large free water weight quantity. At the middle location "m", the water weight sensor is usually more influenced by changes in the amount of free water than by changes in the amount of dry stock. Most preferably location "m" is selected so as to be sensitive to both stock weight and free changes. Finally, location "d", which is closest to the drying section, is selected so that the water weight sensor is sensitive to changes in the dry stock because at this point of the de-water process the amount of water bonded to or associated with the fiber is proportional to the fiber weight. This water weight sensor is also sensitive to changes in the freeness of the wire although to a lesser extent. Preferably, at position "d" sufficient amounts of water have been removed so that the paper stock has an effective consistency whereby essentially no further fiber loss through the fabric occurs.

In measuring paper stock, the conductivity of the mixture is high and dominates the measurement of the sensor. The conductivity of the paper stock is directly proportional to the total water weight within, consequently providing information which can be used to monitor and control the quality of the paper sheet produced by the papermaking system. In order to use this sensor to determine the weight of fiber in a paper stock mixture by measuring its conductivity, the paper stock is in a state such that all or most of the water is held by the fiber. In this state, the water weight of the paper stock relates directly to the fiber weight and the conductivity of the water weight can be measured and used to determine the weight of the fiber in the paper stock.

During initial operation of the system as illustrated in FIG. 1, wet stock is partially dewatered in the wet end that yields a partially dewatered product 91. In this start-up phase, the partially dewatered product 91 is collected for recycle. After this initial process has been completed, the partially dewatered product 91 will enter the dry end process which yields finished paper that is collected at the reel 4. A scanning sensor 14 measures the dry end basis weight to confirm that the process parameters have been correctly selected.

During the initial phase, an MD array of sensors 9A, 9B, and 9C measures the water weight at the wet end and transmit signals to computer 160 which continuously develops water weight profiles of the wet end process. These measured water weight profiles are compared to the base or optimal water weight profile that has been selected for the particular grade of paper being made from a database. FIG. 5 is a graph of water weight versus wire position illustrating implementation of the process. As shown, curve A represents a base or optimal profile that has been preselected from the database for the grade of paper that is being made. During the start-up phase, water weight measurements at the wire are made by the MD array of sensors and from measurements curve B is created using standard curve fitting methods.

As is apparent, in this case the measured water weight values are higher than those of the base profile. As a result, the computer will transmit appropriate signals to controller 21 that will regulate the mechanical element in the refiner, e.g., increase or decrease the refiner plate gap, in refiner 20 that is also equipped with tachometer to measure the motor speed. This curve comparison procedure continues until the measured water weight profile matches the preselected optimized profile. In practice, 100% matching will not be necessary or practical and the level of deviation can be set by the operator. Therefore, it is understood that the term "match" or "matching" implies that the measured water weight profile has the same or approximately the same values as that of the preselected water base weight profile. Referring to FIG. 5, a preferred method of comparing the measured water weight values with those of the base profile entails comparing the three measurements at positions x, y, and z for each profile rather than the two curves. Furthermore, depending on the grade of paper, it may be that measurements closer to the dry line at position z may be more significant that those near the headbox at position x. In this case, the operator may require a higher degree of agreement at position z than at position x. After the proper refiner load is reached, i.e., when the measured profile matches the base profile, the dry end process goes on line and finished product is made. The computer is employed to maintain proper refiner load. Thus, if the measured water weight values are higher than those of the base profile, computer 160 will transmit appropriate signals to controller 21 that will change the load on the refiner.

The control system is particularly suited in the event of a sheet break when the process is much more dynamic and there are few methods of monitoring the stability and status of the wet end of the paper machine. During a paper break the control system will maintain a stable drainage model to ensure that the formation and overall quality of the sheet does not degrade dramatically. In doing so, the control system will maintain a sheet quality which will make it easier to thread the paper during the end of a sheet break condition even with the changing broke levels. Typically, the refining load will be reduced as the broke flow is increased to maintain the drainage model.

Structure of $UW^3$ Sensor

Figure 2:
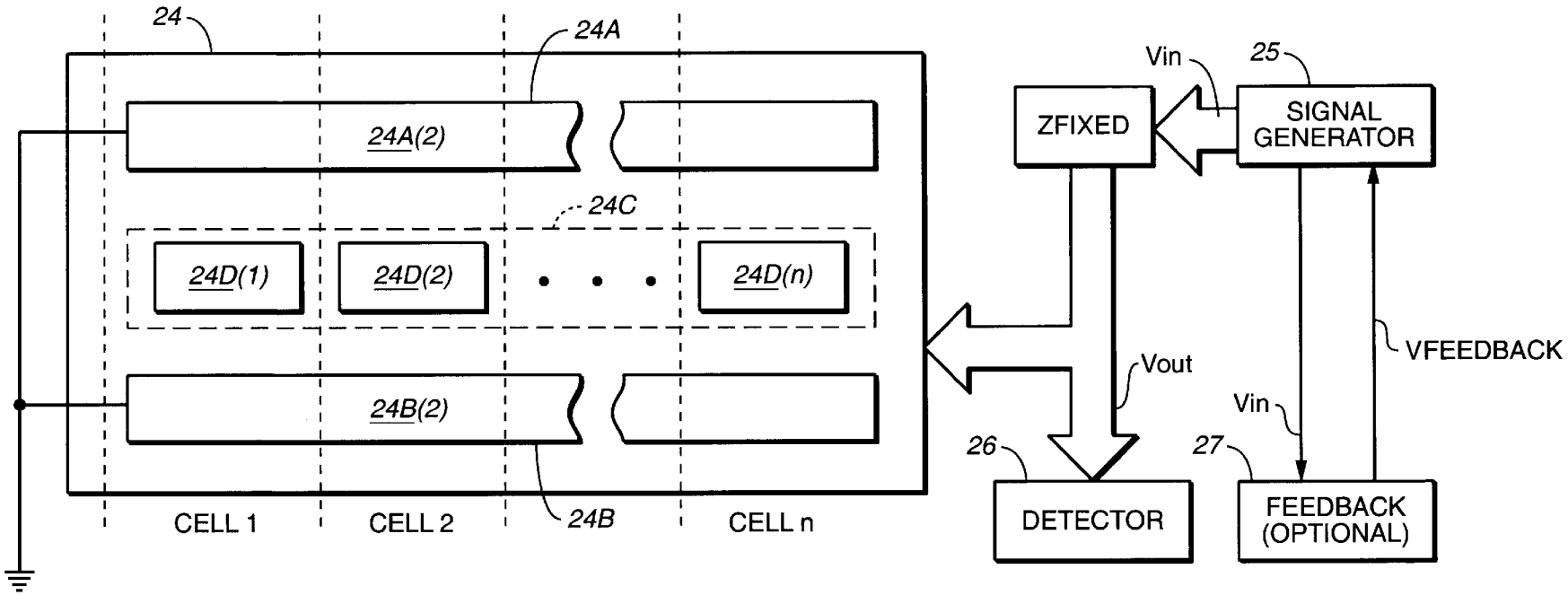
FIG. 2 shows a block diagram of a measurement apparatus including a sensor array.

FIG. 2 shows a conductivity or resistance measurement sensor, described in U.S. patent application Ser. No. 08/766,864 which is incorporated herein by reference, which measures the conductivity or resistance of the water in the stock material. (The sensor can also measure the dielectric constant and the proximity of material, e.g., wet stock, to the sensor.) The conductivity of the water is proportional to the water weight. A sensor array includes two elongated grounded electrodes 24A and 24B and a segmented electrode 24C. Measurement cells (cell1, cell2, . . . celln) each include a segment of electrode 24C and a corresponding portion of the grounded electrodes (24A and 24B) opposite the segment. Each cell detects the conductivity of the paper stock and specifically the water portion of the stock residing in the space between the segment and its corresponding opposing portions of grounded electrode. Although the sensor array may comprise multiple cells, it is understood that each $UW^3$ sensor requires only one cell structure, e.g., cell 2 of FIG. 2. Indeed, even though the preferred detector comprises three electrodes, two of which are grounded, the required number of electrodes is only two, with one being ground.

Each cell is independently coupled to an input voltage (Vin) from signal generator 25 through an impedance element Zfixed and each provides an output voltage to voltage detector 26 on bus Vout. Signal generator 25 provides Vin.

Device 26 includes circuitry for detecting variations in voltage from each of the segments in electrodes 24C and any conversion circuitry for converting the voltage variations into useful information relating to the physical characteristics of the aqueous mixture. Optional feedback circuit 27 includes a reference cell having similarly configured electrodes as a single cell within the sensor array. The reference cell functions to respond to unwanted physical characteristic changes in the aqueous mixture other than the physical characteristic of the aqueous mixture that is desired to be measured by the array. For instance, if the sensor is detecting voltage changes due to changes in weight, the reference cell is configured so that the weight remains constant. Consequently, any voltage/conductivity changes exhibited by the reference cell are due to aqueous mixture physical characteristics other than weight changes (such as temperature and chemical composition). The feedback circuit uses the voltage changes generated by the reference cell to generate a feedback signal (Vfeedback) to compensate and adjust Vin for these unwanted aqueous mixture property changes (to be described in further detail below). It should also be noted that the non-weight related aqueous mixture conductivity information provided by the reference cell may also provide useful data in the sheetmaking process.

The sensor array is sensitive to three physical properties of the material being detected: the conductivity or resistance, the dielectric constant, and the proximity of the material to the sensor. Depending on the material, one or more of these properties will dominate. The material capacitance depends on the geometry of the electrodes, the dielectric constant of the material, and its proximity to the sensor. For a pure dielectric material, the resistance of the material is infinite (i.e., $Rm=\infty$) between the electrodes and the sensor measures the dielectric constant of the material. Alternatively, for a highly conductive material, the resistance of the material is much less than the capacitive impedance (i.e., $Rm<<Z_{Cm}$), and the sensor measures the conductivity of the material.

Figure 3:
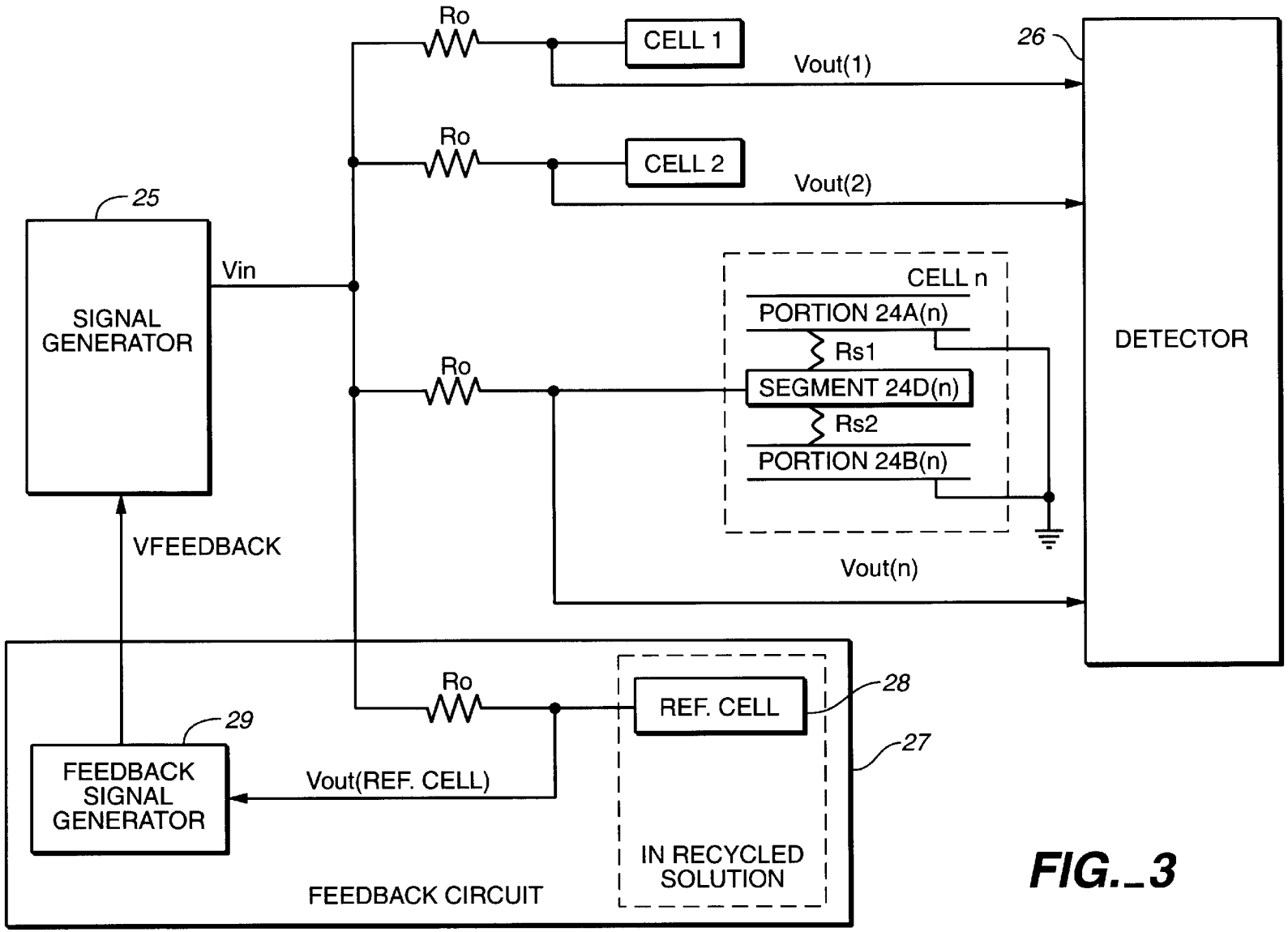
FIG. 3 shows an electrical representation of the block diagram shown in FIG. 2.
Figure 4:
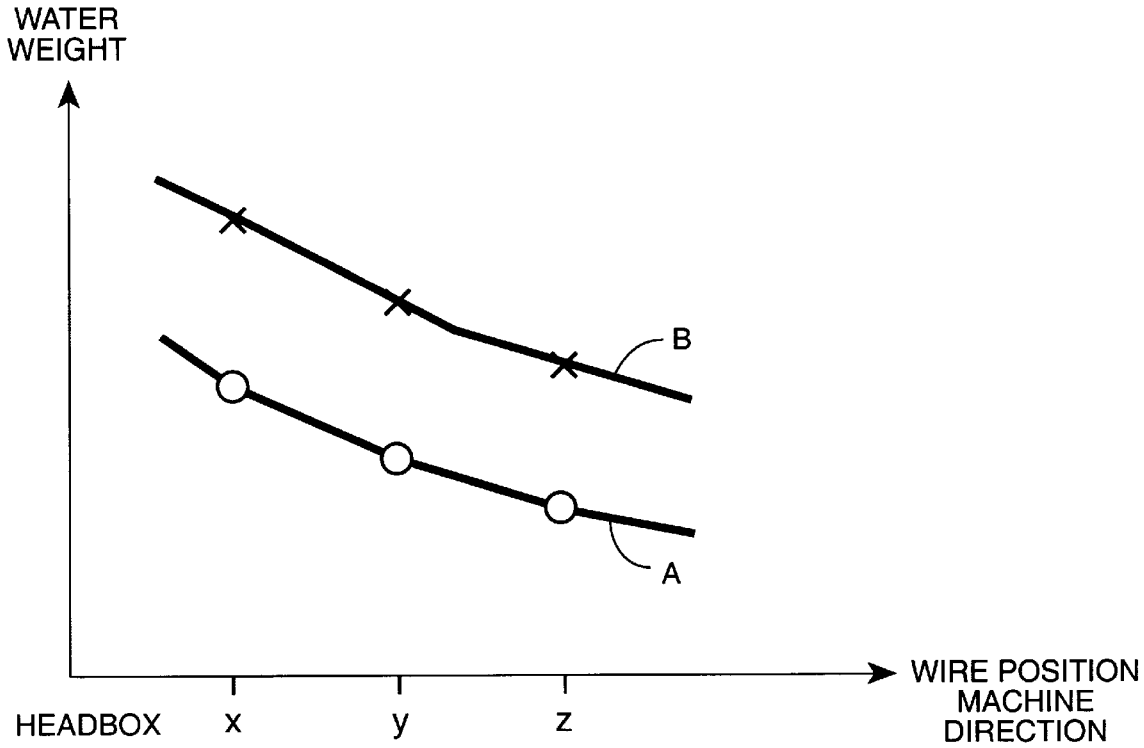
FIG. 4 is a graph of water weight versus wire position on a papermaking machine.

FIG. 3 illustrates an electrical representation of a measuring apparatus including cells 1–n of sensor array 24 for measuring conductivity of an aqueous material. As shown, each cell is coupled to Vin from signal generator 25 through an impedance element which, in this embodiment, is resistive element Ro. Referring to cell n, resistor Ro is coupled to center segment 24D(n) and portions 24A(n) and 24B(n) (opposite segment 24D(n)) are coupled to ground. Also shown in FIG. 6 are resistors Rs1 and Rs2 which represent the conductance of the aqueous mixture between the segments and the grounded portions. Resistors Ro, Rs1, and Rs2 form a voltage divider network between Vin and ground.

The measuring apparatus shown in FIG. 3 is based on the concept that the conductivity of the voltage divider network Rs1 and Rs2 of the aqueous mixture and the weight/amount of an aqueous mixture are inversely proportional. Consequently, as the weight increases/decreases, the combination of Rs1 and Rs2 decreases/increases. Changes in Rs1 and Rs2 cause corresponding fluctuations in the voltage Vout as dictated by the voltage divider network. The voltage Vout from each cell is coupled to detector 26. Hence, variations in voltage inversely proportional to variations in conductivity of the aqueous mixture are detected by detector 26 thereby providing information relating to the weight and amount of aqueous mixture in the general proximity above each cell. Detector 26 also typically includes other circuitry for converting the output signals from the cell into information representing particular characteristics of the aqueous mixture.

FIG. 3 also shows feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if weight is desired to be sensed then the weight is kept constant so that any voltage changes generated by the reference cell are due to physical characteristics other than weight changes. In one embodiment, reference cell 28 is immersed in an aqueous mixture of recycled water which has the same chemical and temperature characteristics of the water in which sensor array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout(ref. cell) generated by the reference cell 28 are due to changes in the conductivity of the aqueous mixture, caused from characteristic changes other than weight. Feedback signal generator 29 converts the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout(ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of controlling the formation of a sheet of wet stock comprising fibers wherein the wet stock is formed on a water permeable moving wire of a de-watering machine that has means for supplying an amount of pulp from at least one source, means for adding an amount of non-fibrous additives to the wet stocks, a refiner that subjects the fibers to mechanical action, said refiner being subject to a variable load, and a headbox having at least one slice, wherein each slice has an aperture through which wet stock is introduced onto the wire, said method comprising the steps of:

(a) placing at least two water weight sensors underneath and adjacent to the wire and which are positioned at different locations in the direction of movement of the wire and upstream from a dry line which develops during operation of the machine;

(b) operating the machine to form a dried sheet product and measuring the water weights of the sheet of wet stock with the water weight sensors;

(c) generating signals that are indicative of the water weight measurements and developing a water weight profile based on the signals;

(d) adjusting at least one of said variable load of the refiner, the amount of non-fibrous additives to the wet stock, or the amount of pulp supplied from the at least one source so that the water weight profile matches a preselected water weight profile; and (e) in response to changes in the water weight profile so that it does not match the preselected water weight profile, readjusting at least one of said variable load of the refiner, the amount of non-fibrous additives to the wet stock, or the amount of pulp supplied from the at least one source until the water weight profile again matches the preselected water profile.

2. The method of claim 1 wherein step (d) comprises adjusting the variable load of the refiner.

3. The method of claim 2 wherein the amount of non-fibrous additives added to the wet stock is maintained within a preselected range.

4. The method of claim 2 wherein the amount of pulp supplied from the at least one source is maintained within a preselected range.

5. The method of claim 1 wherein step (d) comprises adjusting the amount of non-fibrous additives to the wet stock.

6. The method of claim 1 wherein step (d) comprises adjusting the amount of pulp from the at least one source.

7. The method of claim 1 wherein each of said sensors includes a first electrode and a second electrode which is spaced-apart and adjacent to said first electrode, said wet stock being between and in close proximity to said first and said second electrodes, said sensor is coupled in series with an impedance element between an input signal and a reference potential; and wherein fluctuations in at least one property of said wet stock causes changes in voltage measured across said sensor.

8. The method of claim 7 wherein said first electrode is coupled to said impedance element and said second electrode is coupled to said reference potential.

9. The method of claim 8 wherein said impedance element comprises a plurality of resistive elements and said first electrode comprises a plurality of electrically isolated sub-electrodes which are each coupled to one of said plurality of resistive elements.

10. The method of claims 8 further including a third electrode coupled to said reference potential, said first electrode being spaced-apart and residing between said second and said third electrodes, wherein another portion of said sheet of material is between and in close proximity to said first and said third electrodes.

11. The method of claim 7 wherein said first electrode is coupled to said input signal and said second electrode is coupled to said impedance element.

12. The method of claim 11 wherein said second electrode comprises a set of electrically isolated sub-electrodes and said impedance element comprises a plurality of resistive elements, wherein said first electrode is coupled to said input signal and each of said set of sub-electrodes is coupled to one of said plurality of resistive elements.

13. The method of claim 7 further comprising means for providing a feedback signal to adjust said input signal such that said fluctuations in at least one of said properties are due to fluctuations in a single physical characteristic of said wet stock.

14. The method of claim 13 wherein said physical properties include dielectric constant, conductivity, and proximity of said portion of said wet stock to said sensor and said single physical characteristic of said wet stock comprises one of weight, chemical composition, and temperature.

15. The method of claim 7 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

16. The method of claim 15 wherein said sensor has an associated impedance and said associated frequency is adjusted such that said sensor impedance and said impedance of said one of said capacitive element and said inductive element are approximately equal.

17. The method of claim 1 wherein the at least two water weight sensors are positioned substantially in tandem.

18. The method of claim 17 wherein step (a) comprises placing at least three sensors.

19. The method of claim 1 wherein step (b) comprises the step of providing the headbox with pulp from a source of pulp and wherein the change in the water weight profile is caused by a breakage in the sheet of wet stock or the sheet of dried product and wherein at least parts of the sheet of wet stock or dried sheet product that are broken are recycled to the source of pulp.

20. A system of controlling the formation of wet stock, in the production of a dried sheet product, which comprises fibers on a moving water permeable wire of a de-watering machine that comprises means for supplying an amount of pulp from at least one source, means for adding an amount of non-fibrous additives to the wet stock, a refiner that subjects the fibers to mechanical action, said refiner having a motor load controller, and a headbox having at least one slice, wherein each slice has an aperture through which wet stock is discharged onto the wire, which system comprises:

(a) at least two water weight sensors that are positioned adjacent to the wire wherein the at least two sensors are positioned at different locations in the direction of movement of the wire and downstream from a dry line which develops during operation of the machine and the sensors generate signals indicative of a water weight profile made up of a multiplicity of water weight measurements;

(b) means for adjusting at least one of the motor load controller, the amount of non-fibrous additives added to the wet stock, or the amount of pulp supplied from the at least one source to cause water weight profile to match a preselected water weight profile; and (c) means for adjusting at least one of said variable load of the refiner, the amount of non-fibrous additives to the wet stock, or the amount of pulp supplied from the at least one source until the water weight profile again matches the preselected water profile in responses to changes in the water weight profile so that it does not match the preselected water weight profile.

21. The system of claim 20 wherein the amount of non-fibrous additives added to the wet stock is maintained within a preselected range.

22. The system of claim 20 wherein the amount of pulp supplied from the at least one source is maintained within a preselected range.

23. The system of claim 20 wherein each of said sensors includes a first electrode and a second electrode which is spaced-apart and adjacent to said first electrode, said wet stock being between and in close proximity to said first and said second electrodes, said sensor is coupled in series with said impedance element between an input signal and a reference potential; and wherein fluctuations in at least one property of said wet stock causes changes in voltage measured across said sensor.

24. The system of claim 23 wherein said first electrode is coupled to said impedance element and said second electrode is coupled to said reference potential.

25. The system of claim 24 wherein said impedance element comprises a plurality of resistive elements and said first electrode comprises a plurality of electrically isolated sub-electrodes which are each coupled to one of said plurality of resistive elements.

26. The system of claim 25 wherein said second electrode comprises a set of electrically isolated sub-electrodes and said impedance element comprises a plurality of resistive elements, wherein said first electrode is coupled to said input signal and each of said set of sub-electrodes is coupled to one of said plurality of resistive elements.

27. The system of claims 24 further including a third electrode coupled to said reference potential, said first electrode being spaced-apart and residing between said second and said third electrodes, wherein another portion of said sheet of material is between and in close proximity to said first and said third electrodes.

28. The system of claim 23 further comprising means for providing a feedback signal to adjust said input signal such that said fluctuations in at least one property are due to fluctuations in a single physical characteristic of said wet stock.

29. The system of claim 28 wherein said physical properties include dielectric constant, conductivity, and proximity of said portion of said wet stock to said sensor and said single physical characteristic of said wet stock comprises one of weight, chemical composition, and temperature.

30. The system of claim 23 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

31. The system of claim 30 wherein said sensor has an associated impedance and said associated frequency is adjusted such that said sensor impedance and said impedance of said one of said capacitive element and said inductive element are approximately equal.

32. The system of claim 20 wherein the water weight sensors are positioned substantially in tandem.

33. The system of claim 32 wherein the system comprises at least three sensors that are underneath and adjacent to the wire.

34. The system of claim 23 wherein said first electrode is coupled to said input signal and said second electrode is coupled to said impedance element.

* * * * *

UNITED STATES PATENT AND TRADEMARK OFFICE

CERTIFICATE OF CORRECTION

PATENT NO. : 6,086,716
DATED : May 30, 2000
INVENTOR(S) : James T. Higgins

It is certified that error appears in the above-identified patent and that said Letters Patent is hereby corrected as shown below:

ON THE TITLE PAGE, under [63] Related Data (Application Filing Request Sheet 1, No. 3, line 2), USSN 08/542,722 "continuation-in-part" should be --division--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*